US011203733B2

(12) United States Patent
Zou et al.

(10) Patent No.: US 11,203,733 B2
(45) Date of Patent: Dec. 21, 2021

(54) CLEANING COMPOSITIONS AND METHODS OF CLEANING EQUIPMENT

(71) Applicant: Kemira Oyj, Helsinki (FI)

(72) Inventors: Yong Zou, Atlanta, GA (US); Frank Zimmermann, Atlanta, GA (US)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 16/462,552

(22) PCT Filed: Dec. 13, 2017

(86) PCT No.: PCT/FI2017/050881
§ 371 (c)(1),
(2) Date: May 21, 2019

(87) PCT Pub. No.: WO2018/109273
PCT Pub. Date: Jun. 21, 2018

(65) Prior Publication Data

US 2019/0345418 A1 Nov. 14, 2019

Related U.S. Application Data

(60) Provisional application No. 62/433,497, filed on Dec. 13, 2016.

(30) Foreign Application Priority Data

Jan. 4, 2017 (FI) ..... 20175008

(51) Int. Cl.
*C11D 11/00* (2006.01)
*C11D 1/825* (2006.01)
(Continued)

(52) U.S. Cl.
CPC ..... *C11D 11/0041* (2013.01); *C11D 1/8255* (2013.01); *C11D 3/2068* (2013.01);
(Continued)

(58) Field of Classification Search
CPC ..... C11D 11/0041; C11D 3/2093
See application file for complete search history.

(56) References Cited

U.S. PATENT DOCUMENTS 3,950,276 A * 4/1976 Grand ..... C11D 1/22 510/352
5,814,163 A 9/1998 Wojcik
(Continued)

FOREIGN PATENT DOCUMENTS

CN 102464915 A 5/2012
EP 1313815 B1 5/2006
(Continued)

OTHER PUBLICATIONS

Finnish Patent and Registration Office, search report of Finnish patent application No. 20175008, dated Jun. 30, 2017, 2 pages.

*Primary Examiner* — Necholus Ogden, Jr.
(74) *Attorney, Agent, or Firm* — Meunier Carlin & Curfman LLC

(57) ABSTRACT

Compositions for cleaning equipment, preferably paper or carpet making equipment, and methods of cleaning equipment, preferably paper or carpet making equipment using the said composition. The cleaning composition comprises of one or more fatty acid methyl esters, preferably vegetable oil methyl ester, more preferably soybean oil methyl ester, one or more alkene carbonate, preferably propylene carbonate; one of more surfactants, preferably nonionic surfactants; and one or more glycol ether and/or dibasic ester containing solvents.

13 Claims, 1 Drawing Sheet

(51) Int. Cl.

| | |
|---|---|
| ***C11D 3/20*** | (2006.01) |
| ***C11D 3/43*** | (2006.01) |
| ***D21F 1/32*** | (2006.01) |
| *C11D 1/72* | (2006.01) |

(52) U.S. Cl.
CPC ..... *C11D 3/2093* (2013.01); *C11D 3/2096* (2013.01); *C11D 3/43* (2013.01); *D21F 1/32* (2013.01); *C11D 1/72* (2013.01)

(56) References Cited

U.S. PATENT DOCUMENTS

| | | | | |
|---|---|---|---|---|
| 6,369,010 | B1 | 4/2002 | Dreisbach et al. | |
| 9,945,074 | B1 * | 4/2018 | Lasik | C11D 3/2093 |
| 2011/0021398 | A1 | 1/2011 | Allef et al. | |
| 2014/0057820 | A1 * | 2/2014 | Lasik | C11D 7/261<br>510/109 |
| 2014/0352731 | A1 * | 12/2014 | Atabong | C11D 7/266<br>134/22.14 |
| 2015/0252294 | A1 * | 9/2015 | Weerasooriya | C11D 1/29<br>510/392 |

FOREIGN PATENT DOCUMENTS

| | | | |
|---|---|---|---|
| WO | 0174984 | A1 | 10/2001 |
| WO | 0218502 | A2 | 3/2002 |
| WO | 2010088194 | A2 | 8/2010 |
| WO | 2012054465 | A2 | 4/2012 |

* cited by examiner

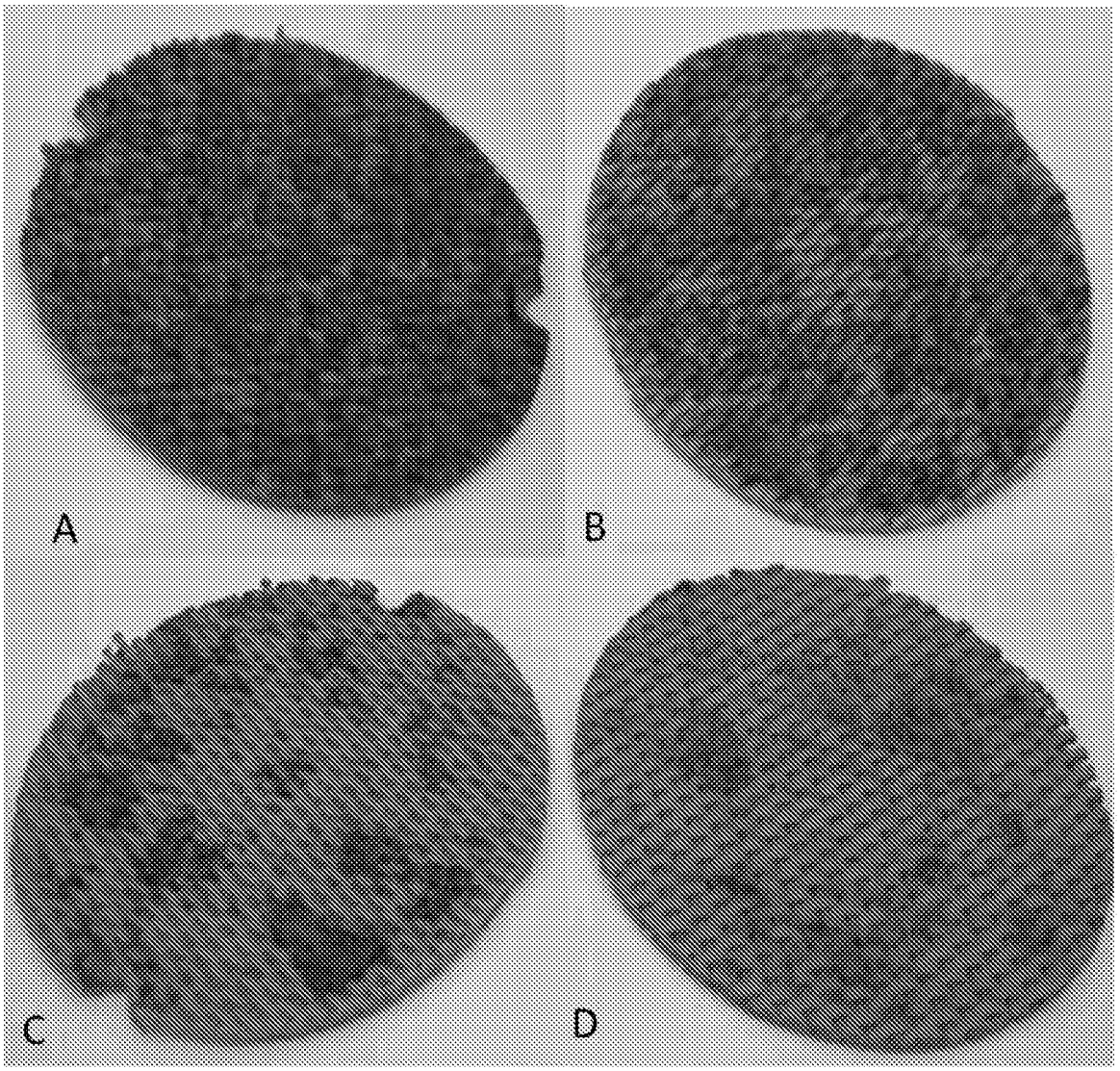
A
B
C
D

CLEANING COMPOSITIONS AND METHODS OF CLEANING EQUIPMENT

PRIORITY

This application is a U.S national application of the international application number PCT/FI2017/050881 filed on Dec. 13, 2017 and claiming priority of provisional application 62/433,497 filed on Dec. 13, 2016 and Finnish application 20175008 filed on Jan. 4, 2017 the contents of all of which are incorporated herein by reference.

FIELD OF THE INVENTION

This invention relates to cleaning compositions and methods of cleaning equipment, preferably paper or carpet making equipment with said compositions.

BACKGROUND OF THE INVENTION

In papermaking industry, many papers are made from recycled pulp. Use of recycled pulp often adds more contaminants to the papermaking system which tends to clog suction holes and interfere with vacuum rolls ability to direct the bulk sheet and its turns through the machinery, causing breaks and downtime. Surfaces of paper making equipment such as press fabric, dryer fabric and forming wire often become coated with these contaminants and loose permeability after a period of time causing sheet defects and downtime. Similar issues are common with carpet making machines, especially when carpets are made from textile materials.

The chemical cleaners currently in use in paper making industry are either highly caustic, aromatic hydrocarbon based or blends. They are not renewable or biodegradable. They are corrosive, have low flash points and high volatile organic compounds (VOC) relative to regulatory requirements for these types of industrial applications.

Thus there is a need for environment friendly, safe, renewable and biodegradable cleaners for cleaning paper or carpet making equipment.

SUMMARY OF THE INVENTION

One objective of the present invention is to provide solutions to at least some of the problems encountered in the prior art, or to minimize the disadvantages existing in the prior art.

In particular, one objective of the present invention is to provide a biodegradable, safe and efficient composition for cleaning equipment, specifically paper or carpet making equipment.

One object of the present invention is to provide a composition for cleaning felts and/or wires in making of paper, board, tissue or the like, especially when using recycled fibers.

These objects are attained with the invention having the characteristics presented below in the characterizing parts of the independent claims. Some preferred embodiments of the invention are presented in the dependent claims. The features recited in the dependent claims are freely combinable with each other unless otherwise explicitly stated.

A typical cleaning composition according to present invention comprises one or more alkylene carbonates, preferably propylene carbonate; one or more fatty acid methyl esters, preferably vegetable oil methyl esters, more preferably soybean oil methyl ester; one or more glycol ether or dibasic ester containing solvents; and one or more surfactants, preferably nonionic surfactants.

A typical method according to the present invention for cleaning equipment comprises: contacting the equipment with a cleaning composition comprising one or more alkylene carbonates, preferably propylene carbonate; one or more fatty acid methyl esters, preferably vegetable oil methyl esters, more preferably soybean oil methyl ester; one or more glycol ether or dibasic ester containing solvents; and one or more surfactants, preferably nonionic surfactants.

A typical use according to the present invention of cleaning composition according the invention is for cleaning of equipment of making of paper, board, tissue or the like, preferably dryer fabric, press fabric or forming wire.

In certain embodiments the paper making equipment to be cleaned are equipment used to make recycled tissue paper, recycled board, recycled fine paper and paper to be used with food contact.

In certain embodiments contaminants cleaned includes, but are not limited to, hot melt glue, adhesives and contaminants found in old corrugated container papers.

Cleaning compositions of the current invention have multiple advantages. The compositions are biodegradable and environmentally friendly. The cleaning compositions have low volatile organic compounds, below 30% and have high flash point, above 110° C. The compositions show low foaming and no separation, even at 45° C. for 1.5 months. The cleaning compositions are FDA compliant and thus are suitable for cleaning equipment used in making papers to be used with food contact. The cleaning compositions also show synergistic effect, have higher cleaning efficiency or capacity than the individual components. The cleaning compositions have pH between 4 to 6 and solutions obtained after cleaning the equipment with the compositions have pH close to 7.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of the specification embodiments presented herein.

FIG. 1A: Original uncleaned sample from a dryer fabric used to process old corrugated container.

FIG. 1B: Control sample, sample after cleaning with deionized water.

FIG. 1C: Sample after cleaning with test composition 1.

FIG. 1D: Sample after cleaning with test composition 2.

DETAILED DESCRIPTION OF THE INVENTION

The present invention provides biodegradable, safe and environmentally friendly cleaning composition for various types of industrial equipment, especially for those used in paper or carpet making where clogging of various types of felts, wires and filters is a common problem.

Thus, certain embodiments of the invention are related to cleaning compositions comprising one or more alkylene carbonates, preferably propylene carbonate, one or more fatty acid methyl esters, preferably vegetable oil methyl esters, more preferably soybean oil methyl esters, one or more surfactants, preferably nonionic surfactants, and one or more glycol ether or dibasic ester containing solvents. In certain embodiments total fatty acid methyl ester concentration is 25%-45%, preferably 30%-38%. In certain embodiments total alkylene carbonate concentration is 25%-45%, preferably 30%-38%. In certain embodiments total surfactant concentration is 5%-27%, preferably 7-20%. In certain embodiments total glycol ether or dibasic ester containing agent solvent concentration is 10%-45%, preferably 10%-25%. In certain embodiments such cleaning compositions are further diluted with one or more diluting agents wherein starting diluting agent:composition, weight:weight, ratio is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30-38% propylene carbonate; one or more nonionic surfactants with total surfactant concentration 5%-27%, preferably 7%-20%; and one or more glycol ether or dibasic ester containing solvents with total solvent concentration 10%-45%; preferably 10%-25%. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 3%-15% dodecanol ethoxylate; 2%-10% ethoxylated 2,4,7,9-tetramethyl-5-decyne-4,7-diol; and 10%-45%, preferably 10%-25% of a mixture of ethylene glycol monophenyl ether, diethylene glycol monophenyl ether, triethylene glycol monophenyl ether and polyethylene glycol monophenyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 2%-10% ethoxylated 2,4,7,9-tetramethyl-5-decyne-4,7-diol; 3%-15% isotridecyl alcohol ethoxylate; and 10%-45%, preferably 10%-25% of a mixture of ethylene glycol monophenyl ether, diethylene glycol monophenyl ether, triethylene glycol monophenyl ether and polyethylene glycol monophenyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 3%-15% ethoxylated 2,4,7,9-tetramethyl-5-decyne-4,7-diol; 2%-10% dodecanol ethoxylate; 10%-45%, preferably 10%-25% dimethyl 2-methylglutarate; 0.1%-1% 2,4,7,9-tetramethyl-5-decyne-4,7-diol; and 0.1%-1% ethoxylated C11-C15 secondary alcohols. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 3%-15% ethoxylated 2,4,7,9-tetramethyl-5-decyne-4,7-diol; 2%-10% dodecanol ethoxylate; 0.1%-1% 2,4,7,9-tetramethyl-5-decyne-4,7-diol; 0.1-1% ethoxylated C11-C15 secondary alcohols; and 10%-45% preferably 10%-25% of a mixture of ethylene glycol monophenyl ether, diethylene glycol monophenyl ether, triethylene glycol monophenyl ether and polyethylene glycol monophenyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 2%-10% ethoxylated 2,4,7,9-tetramethyl-5-decyne-4,7-diol; 3%-15% tridecyl alcohol ethoxylate; and 10%-45% preferably 10%-25% diethylene glycol monobutyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 2%-10% ethoxylated 2,4,7,9-tetramethyl-5-decyne-4,7-diol; 3%-15% dodecanol ethoxylate; and 10%-45% preferably 10%-25% diethylene glycol monobutyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1 including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 2%-10% ethoxylated 2,4,7,9-tetramethyl-5-decyne-4,7-diol; 3%-15% tridecyl alcohol ethoxylate; and 10%-45%, preferably 10%-25% diethylene glycol monoethyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 2%-10% ethoxylated 2,4,7,9-tetramethyl-5-decyne-4,7-diol; 3%-15% dodecanol ethoxylate; and 10%-45%, preferably 10%-25% diethylene glycol monoethyl ether. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 3%-15% ethoxylated 2,4,7,9-tetramethyl-5-decyne-4,7-diol; 2%-10% tridecyl alcohol ethoxylate; 10%-45%, preferably 10%-25% diethylene glycol monobutyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38% propylene carbonate; 3%-15%, ethoxylated 2,4,7,9-tetramethyl-5-decyne-4,7-diol; 2%-10% dodecanol ethoxylate; 10%-45%, preferably 10%-25% diethylene glycol monobutyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% tridecyl alcohol ethoxylate; 10%-45%, preferably 10%-25%, diethylene glycol monoethyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between.

Certain embodiments of the invention are related to cleaning compositions comprising 25%-45%, preferably 30%-38% soybean oil methyl ester; 25%-45%, preferably 30%-38%, propylene carbonate; 3%-15% ethoxylated 2,4,7,9-tetramethyl-5-decyne-4,7-diol; 2%-10% dodecanol ethoxylate; 10%-45%, preferably 10%-25%, diethylene glycol monoethyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1 including but not limited to any or all ratios in between.

Certain embodiments of the invention are related to methods of cleaning equipment, preferably paper making or carpet making equipment, comprising contacting the equipment with a cleaning composition comprising one or more alkylene carbonates, preferably propylene carbonate; one or more fatty acid methyl esters, preferably vegetable oil methyl esters, more preferably soybean oil methyl esters; one or more surfactants, preferably nonionic surfactants; and one or more glycol ether or dibasic ester containing solvents. In certain embodiments total fatty acid methyl ester concentration is 25%-45%, preferably 30%-38%. In certain embodiments total alkylene carbonate concentration is 25%-45%, preferably 30%-38%. In certain embodiments total surfactant concentration is 5%-27%, preferably 7-20%. In certain embodiments total glycol ether or dibasic ester containing agent solvent concentration is 10%-45%, preferably 10%-25%. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30-38%, propylene carbonate; one of more nonionic surfactants with total surfactant concentration 5%-27%, preferably 7%-20%; and one or more glycol ether or dibasic ester containing solvents with total solvent concentration 10%-45%, preferably 10%-25%. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1 or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 3%-15% dodecanol ethoxylate; 2%-10% ethoxylated 2,4,7,9-tetramethyl-5-decyne-4,7-diol; and 10%-45%, preferably 10%-25%, of a mixture of ethylene glycol monophenyl ether, diethylene glycol monophenyl ether, triethylene glycol monophenyl ether and polyethylene glycol monophenyl ether. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 2%-10% ethoxylated 2,4,7,9-tetramethyl-5-decyne-4,7-diol, 3%-15% isotridecyl alcohol ethoxylate; and 10%-45%, preferably 10%-25%, of a mixture of ethylene glycol monophenyl ether, diethylene glycol monophenyl ether, triethylene glycol monophenyl ether and polyethylene glycol monophenyl ether. In certain embodiments such cleaning compositions are further diluted, before and/or while in contact with the equipment, with one or more diluting agents wherein starting diluting agent:composition, weight:weight, ratio is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper or carpet making equipment, comprising contacting the equipment with a cleaning composition comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% dodecanol ethoxylate; 10%-45% preferably 10%-25% dimethyl 2-methylglutarate; 0.1%-1% 2,4,7,9-tetramethyl-5-decyne-4,7-diol; and 0.1%-1% ethoxylated C11-C15 secondary alcohols. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% dodecanol ethoxylate; 0.1%-1% 2,4,7,9-tetramethyl-5-decyne-4,7-diol; 0.1%-1% ethoxylated C11-C15 secondary alcohols; and 10%-45%, preferably 10%-25%, of a mixture of ethylene glycol monophenyl ether, diethylene glycol monophenyl ether, triethylene glycol monophenyl ether and polyethylene glycol monophenyl ether. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 2%-10% ethoxylated 2,4,7,9-tetramethyl-5-decyne-4,7-diol; 3%-15% tridecyl alcohol ethoxylate; and 10%-45%, preferably 10%-25%, diethylene glycol monobutyl ether. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 2%-10% ethoxylated 2,4,7,9-tetramethyl-5-decyne-4,7-diol; 3%-15% dodecanol ethoxylate; and 10%-45%, preferably 10%-25%, diethylene glycol monobutyl ether. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 2%-10% ethoxylated 2,4,7,9-tetramethyl-5-decyne-4,7-diol; 3%-15% tridecyl alcohol ethoxylate; and 10%-45%, preferably 10%-25% diethylene glycol monoethyl ether. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 2%-10% ethoxylated 2,4,7,9-tetramethyl-5-decyne-4,7-diol; 3%-15% dodecanol ethoxylate; and 10%-45% preferably 10%-25%, diethylene glycol monoethyl ether. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% tridecyl alcohol ethoxylate; 10%-45%, preferably 10%-25%, diethylene glycol monobutyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% dodecanol ethoxylate; 10%-45%, preferably 10%-25%, diethylene glycol monobutyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1 including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% tridecyl alcohol ethoxylate; 10%-45%, preferably 10%-25%, diethylene glycol monoethyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted, before and/or while in contact with the equipment, with one or more diluting agents wherein starting diluting agent:composition ratio, weight:weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Certain embodiments of the invention are related to methods of cleaning equipment, preferably paper making or carpet making equipment, comprising contacting the equipment with a cleaning composition comprising 25%-45%, preferably 30%-38%, soybean oil methyl ester; 25%-45%, preferably 30%-38%, propylene carbonate; 3%-15% ethoxylated 2,4,7,9-tetramethyl-5-decyne-4,7-diol; 2%-10% dodecanol ethoxylate; 10%-45%, preferably 10%-25% diethylene glycol monoethyl ether; 0.1%-1% 2,4,7,9-tetramethyl-5-decyne-4,7-diol; and 0.1%-1% ethoxylated C11-C15 secondary alcohols. In certain embodiments such cleaning compositions are further diluted, before and/or while in contact with the equipment, with one or more diluting agents wherein starting diluting agent:composition ratio, weight: weight, is 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including but not limited to any or all ratios in between. In certain embodiments cleaning is performed at elevated temperatures. In certain other embodiments the contact time is between 0.1 second to 5 hours, preferably between 30 secs to 1 hour, more preferably 1 minute to 30 minutes. In certain other embodiments the paper making equipment is dryer fabric, press fabric, forming wire, rolls or other paper machine surface.

Other embodiments of the invention are discussed throughout this application. Any embodiment discussed with respect to one aspect of the invention applies to other aspects of the invention as well and vice versa. Each embodiment described herein is understood to be embodiments of the invention that are applicable to all aspects of the invention. It is contemplated that any embodiment discussed herein can be implemented with respect to any method or composition of the invention, and vice versa. Furthermore, compositions and kits of the invention can be used to achieve methods of the invention.

Definitions

The use of the word "a" or "an" when used in conjunction with the term "comprising" in the claims and/or the specification may mean "one," but it is also consistent with the meaning of "one or more," "at least one," and "one or more than one."

Throughout this document, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this disclosure, the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Percentages of components in compositions described throughout this application are weight percentages of the components in the compositions. Weight percentages are calculated with the assumption that the components contain no impurities.

Surfactant as referred in this disclosure contain hydrophilic head group and hydrophobic tail group. Surfactants useful for the current invention make the components of the composition miscible with each other, keeps them well dispersed in the composition and forms micro-emulsion, which is isotropic and thermodynamically stable. For example, in absence of surfactant, soybean oil methyl ester and propylene carbonate do not mix, at least in adequate manner, with each other. The surfactant enhances also the cleaning efficiency of the individual components of the composition.

According to one preferable embodiment the surfactant is non-ionic surfactant. Nonionic surfactants are surfactants with an uncharged hydrophilic head group and they do not dissociate into ions or ionic constituents in aqueous solutions. Nonionic surfactants include ethoxylates, especially fatty alcohol ethoxylates; alkoxylates; and cocamides.

The surfactant concentration, especially, the nonionic surfactant concentration, in the cleaning composition may be 5-27 weight-%, preferably 7-20 weight-%. According to one embodiment the nonionic surfactant composition may be >10 weight-%, for example more than 10 weight-% but less than 20 weight-%. The surfactant concentration provides good stability and miscibility for the individual components of the composition, while reducing the risk of foaming or other adverse effects during the cleaning procedure. It has been observed that the compositions show no separation, even when stored at 45° C. for 1.5 months. The compositions have thus good storage stability, even at elevated temperature.

According to one embodiment the composition comprises one or more nonionic surfactants, which may be selected from the group consisting of isotridecyl alcohol ethoxylate, dodecanol ethoxylate, tridecyl alcohol ethoxylate, ethoxylated 2,4,7,9-tetramethyl-5-decyne-4,7-diol, 2,4,7,9-tetramethyl-5-decyne-4,7-diol, ethoxylated C11-C15 secondary alcohols, acetylenic diol containing surfactants and any combination thereof. It has been observed that these surfactants provide cleaning compositions with good properties, especially for cleaning of felts, wires, filters in papermaking processes or the like.

According to one embodiment the composition comprises at least two or more different nonionic surfactants. It is possible that the composition comprises up to four, five or six different surfactants. The composition may comprise at least two major surfactants and at least two minor surfactants. The major and minor surfactants are preferably selected from the nonionic surfactants listed above. Major and minor refer here to concentrations of surfactants. The concentration of the major surfactant may be in the range of 2-15 weight-%, preferably 2-10 weight-% or 3-15 weight-%. The concentration of the minor surfactant may be 0.1-1 weight-%. The possibility of using a plurality of surfactants in different amount and combinations enables flexible tailoring of the properties of the cleaning composition. This reduces adversary side effects, such as foaming, and improves the performance of the other components of the coating composition.

Tridecyl alcohol ethoxylates are nonionic surfactants containing one or more moles of ethylene oxide per one mole of tridecyl alcohol. In certain embodiments the composition comprises tridecyl alcohol ethoxylate, having a mole ratio of ethylene oxide and isotridecyl alcohol may be in the range from 7:1 to 11:1, preferably 9:1.

Dodecanol ethoxylates are nonionic surfactants containing one or more moles of ethylene oxide per one mole of dodecanol. In certain embodiments the composition comprises dodecanol ethoxylate, having a mole ratio of ethylene oxide and dodecanol may be in the range from 5:1 to 9:1, preferably 7:1.

Isotridecyl alcohol ethoxylates are nonionic surfactants containing one or more moles of ethylene oxide per one mole of isotridecyl alcohol. In certain embodiments the composition comprises isotridecyl alcohol ethoxylate having a mole ratio of ethylene oxide and isotridecyl alcohol may be in the range from 7:1 to 11:1, preferably 9:1.

The cleaning composition comprises one or more glycol ether or dibasic ester containing solvents. According to one embodiment of the invention the composition comprises one or more glycol ether and/or dibasic ester containing solvents, which may be selected from the group consisting of dimethyl 2-methylglutarate, diethylene glycol monobutyl ether, diethylene glycol monoethyl ether, ethylene glycol monophenyl ether, diethylene glycol monophenyl ether, polyethylene glycol monophenyl ether, triethylene glycol monophenyl ether containing solvents and any combination thereof. According to one preferable embodiment the composition comprises a mixture of ethylene glycol monophenyl ether, diethylene glycol monophenyl ether, triethylene glycol monophenyl ether and polyethylene glycol monophenyl ether.

According to another embodiment the composition comprises diethylene glycol monoethyl ether or dimethyl 2-methylglutarate as the sole glycol ether and/or dibasic ester containing solvent.

According to one embodiment the glycol ether and/or dibasic ester solvent concentration in the composition is 10-45 weight-%, preferably 10-25 weight-%. This concentration is a total concentration, i.e. it includes all glycol ether and/or dibasic ester containing solvents present in the composition.

The cleaning composition further comprises one or more alkylene carbonates. Alkylene carbonate may be ethylene carbonate, propylene carbonate, butylene carbonate or any mixture thereof. According to one embodiment of the invention alkylene carbonate is preferably propylene carbonate. Alkylene carbonate concentration in the cleaning composition may be 25-45 weight-%, preferably 30-38 weight-%.

The cleaning composition comprises one or more fatty acid methyl esters. Fatty acid methyl esters are methyl esters of fatty acids. Fatty acids are 4 to 28, preferably 6 to 22, carbon atom containing carboxylic acids with saturated or unsaturated aliphatic chains. The fatty acid methyl ester concentration in the composition may be 25-45 weight-%, preferably 30-38 weight-%.

Preferably the cleaning composition may comprise one or more vegetable oil methyl esters, such as rapeseed oil ester, sunflower oil ester, palm oil ester, soybean oil ester or any of their mixture, more preferably soybean oil methyl ester. Vegetable oils contain fatty acids. Vegetable oils are triglycerides of fatty acids. Vegetable oil methyl esters contain fatty acid methyl esters. Caproic acid methyl ester, caprylic acid methyl ester, capric acid methyl ester, lauric acid methyl ester, myristic acid methyl ester, palmitic acid methyl ester, stearic acid methyl ester, oleic acid methyl ester, linoleic acid methyl ester, linolenic acid methyl ester, arachidic acid methyl ester, erucic acid methyl ester are some examples of fatty acid methyl esters found in vegetable oil methyl ester.

According to one preferable embodiment the fatty acid methyl ester is soybean oil methyl ester. Myristic acid methyl ester, palmitic acid methyl ester, stearic acid methyl ester, oleic acid methyl ester, linoleic acid methyl ester, linolenic acid methyl ester are primary components of soybean oil methyl esters.

According to one embodiment of the invention the cleaning composition may comprise the following constituents: fatty acid methyl ester concentration may be 25-45%, preferably 30-38%; alkylene carbonate concentration may be 25-45%, preferably 30-38%; surfactant concentration may be 5-27%, preferably 7-20%; and glycol ether or dibasic ester solvent concentration may 10-45%, preferably 10-25%.

According to one embodiment of the present invention the cleaning composition has a flash point above 110° C., preferably above 120° C., more preferably above 130° C., sometimes even above 140° C. High flashpoint is advantageous for the cleaning composition, as it makes it safer to use.

The cleaning composition may have low concentration of volatile organic compounds, such as olefinic hydrocarbons. Preferably the composition is free of olefinic hydrocarbons. Volatile organic compounds, VOCs, are here understood as organic compounds having an initial boiling point<250° C., measured at a standard atmospheric pressure of 101.3 kPa. Volatile organic compounds have vapor pressure of 0.01 kPa or more at 293.15 K. The concentration of volatile organic compounds in the cleaning composition is below 30%, preferably below 25%, more preferably below 20%, sometimes even below 15%. Low concentration of volatile organic compounds improves the occupational safety of the workers using the cleaning composition.

According to one embodiment the cleaning composition according to the present invention may have a pH value between 4 to 7, preferably between 4 to 6.

According to one embodiment the cleaning composition is free of strong oxidants, such as hydrogen peroxide. Strong oxidants may damage the surface of the equipment to be cleaned, especially felts, fabrics or wires used in making of paper, board or tissue.

The cleaning composition may comprise one or more diluting agents or it may be further diluted before and/or while in contact with the equipment to be cleaned with one or more diluting agents. Diluting agents may be water, compatible chemicals, compatible chemical mixtures or premixtures, compatible liquids, compatible solids or combinations thereof. Preferably diluting agent is water. Compatible are those that do not result in separation between the components of compositions and/or precipitation and maintain the micro-emulsion state of the composition while and/or after adding and/or mixing those to the composition. Examples of compatible liquids are various alcohols and hydrocarbons. If compatible chemicals and/or liquids are used, their type and amount should be suitable for keeping the amount of volatile organic compounds low. The diluting agent:composition ratio, weight:weight, may be selected one of the following: 1000:1, 100:1, 90:1, 80:1, 70:1, 60:1, 50:1, 40:1, 30:1, 20:1, 10:1, 8:1, 6:1, 4:1, 2:1, 1:1, 0.1:1, 0.001:1, or 0:1, including any and all ratios in between.

Contact time depends on the area of the equipment being cleaned, the type of equipment surface being cleaned and/or contamination level of the equipment being cleaned. Contact time is optimized such that optimum cleaning is obtained at the expense of minimum loss in production time. Contact method depends on the equipment being cleaned. The contact method may be soaking, spraying or any other suitable contact method. The contact time may be between 0.1 second to 5 hours, preferably between 30 secs to 1 hour, more preferably between 1 minute to 30 minutes.

Contact method, i.e. how the cleaning composition is brought into contact with the equipment to be cleaned, depends on the equipment being cleaned, its location in the process and/or size. The contact method may be soaking, spraying or any other suitable contact method.

The cleaning composition and/or the equipment to be cleaned may be contacted at an elevated temperature. Cleaning at elevated temperatures is performed through heating the cleaning composition or equipment being cleaned or both to an elevated temperature before and/or while in contact with each other. According to one embodiment of the invention the cleaning composition or equipment being cleaned or both are heated to temperature, which is between above room temperature to below 130° C., preferably between 25° C. to 130° C., more preferably between 45° C.

to 70° C., even more preferably between 50° C. to 60° C. At the preferred temperature range, energy optimized cleaning performance is observed.

According to one embodiment of the invention the equipment may paper, board or tissue making equipment, such as dryer fabric, press fabric, forming wire, rolls or other paper making machine surface. Especially suitable the present cleaning composition is for cleaning soft surfaces of paper, board or tissue making equipment, such as dryer fabrics and/or felts, press fabrics and/or felts, as well as various wires, such as forming wires. It has been observed that the cleaning composition effectively removes adhesives and other corresponding contaminants from the surface of the felts, fabrics and wires, without damaging their surface.

EXAMPLES

The following non-limiting examples as well as the figures are included to demonstrate preferred embodiments of the invention. It should be appreciated by those of skill in the art that the techniques disclosed in the examples or figures represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Cleaning compositions with formulations as described in Table 1 were made. Table 2, lists VOCs, flash points and foam formations of the compositions. VOCs were calculated as per EPA method 24. Flash points were calculated according to Pensky-Martens closed cup analysis as per EPA 1010A. Samples with 2" diameter were cut from dryer fabrics used to process old corrugated container. Cut samples were separately weighed and labeled. One sample was not cleaned and was kept as a reference for uncleaned fabric. One sample was marked as the control sample and was cleaned with deionized water instead of any cleaning composition. Two samples were separately cleaned with cleaning compositions, as described in Table 1. Cleaning compositions were separately diluted with deionized water by filling wide jars with 80 g of deionized water and 20 g of cleaning compositions with formulations as described in Table 1. For the control sample, the jar was filed with 100 g deionized water. Samples were placed in separate jars, fully submerged, and left undisturbed for 1 minute. Samples were then taken out from the jar and placed in aluminum pan, and placed in the oven at 50-60° C. under the hood for 30 minutes. The samples were then rinsed with water to remove any leftover cleaner. Tergotometer was used to rinse. Tergotometer is an excellent device for batch cleaning of fabrics because it has constant counter flow action and temperature control. The tergotometer was set at 130° C. Large steel containers were filled with 600 g of hot water. Samples were placed in separate containers. The rinse cycles were run for 15 minutes at 150 rpm, and the pH was recorded during the cycle.

After the cycle was complete, each container was individually poured over a wire sieve and run under water briefly to help rinse any additional contaminants that the treatment had removed. All loose fabric fibers that were shed from the samples during the treatment and rinse cycles, were collected and accounted for in the "percent contaminant removal" calculations. The samples and corresponding lost fibers were placed back in the appropriate dishes and dried at 105° C. The samples were then allowed to cool down to room temperature in a desiccator and the mass of each sample, including the weight of loose fabric fibers that were shed from the samples during the treatment and rinse cycles, was recorded as "after treatment weight". The change in weight or percentage weight loss between the uncleaned sample and clean, dried sample is attributed to contaminant removal or to percentage contaminant removed respectively. Percentage weight loss was calculated as, where "before treatment weight" is weight of uncleaned sample before treatment $$\%\ \text{weight loss} = \left(\frac{\text{before treatment weight} - \text{after treatment weight}}{\text{weight before cleaning}}\right) * 100$$

FIG. 1A: original uncleaned sample, FIG. 1B: control sample after cleaning with deionized water, FIG. 1C: sample after cleaning with test composition 1 and FIG. 1D: sample after cleaning with test composition 2. Table 4 shows percentage weight loss, calculated as described and pH before and after cleaning.

Table 2 shows, the compositions have low VOCs, high flash point and show no or very little foaming in water. Table 3, shows that the compositions are stable at ranges of temperature and the components of the composition do not separate over prolonged periods of time. Table 4, shows the compositions are efficient cleaners. pH of the cleaning solutions are close to neutral pH, before and after cleaning the dryer fabric samples with the cleaning compositions.

TABLE 1

Formulations of test compositions

| Components | Test composition 1 Weight % | Test composition 2 Weight % |
|---|---|---|
| Soybean oil methyl ester (vegetable oil ester) | 34 | 34 |
| Propylene carbonate (alkylene carbonate) | 34 | 34 |
| DOWANOL DIEPh, Dow Chemical Company (glycol ether containing solvent) | 17 | 16.2 |
| Surfynol 465, Evonik Industries (acetylenic nonionic surfactant) | 5 | 10 |
| Sasol Alfonic TDA-9, Sasol Chemicals (ethoxylated alcohol surfactant) | 10 | — |
| Surfynol 107L, Evonik Industries (nonionic surfactant) | — | 0.5 |
| Carbowet GA-211, Evonik Industries (nonionic surfactant) | — | 0.3 |
| Etahl LA-7, Ethox Chemicals (nonionic linear alcohol ethoxylate surfactant) | | 5 |

TABLE 2

VOC, flash point and foam of the product

| | VOCs (%) | Flash point (° C.) | Foam* |
|---|---|---|---|
| Test composition 1 | 14.2 | 133 | A very little |
| Test composition 2 | 26.57 | 133 | No |

*Foam of 20% composition (20 g of the composition, with formulation as described in table 1, in 80 g of water.)

TABLE 3

| Stability of the compositions over 45 days | | | | |
|---|---|---|---|---|
| | 45(° C.) | 23(° C.) | 7(° C.) | −20(° C.)* |
| Test composition 1 | No separation | No separation | No separation | No separation |
| Test composition 2 | No separation | No separation | No separation | No separation |

*No separation after thawing at room temperature

TABLE 4

| Percentage weight loss, pH before and after cleaning | | | |
|---|---|---|---|
| | Weight loss (Average %) | pH before cleaning* | pH after cleaning** |
| Control | 2.16 | — | — |
| Test composition 1 | 5.53 | 5.06 | 7.11 |
| Test composition 2 | 5.39 | 4.65 | 7.26 |

*pH before cleaning is the pH of the 20% composition (20 g of the composition, with formulation as described in table 1, in 80 g of water.)
**pH after cleaning is the pH of the 600 ml water used in the rinse cycle.

The invention claimed is:

1. A cleaning composition for paper or carpet making equipment comprising ingredients selected from the group consisting of:

30 weight-%-38 weight-% of one or more alkylene carbonates;

25 weight-%-45 weight-% of one or more fatty acid methyl esters selected from vegetable oil methyl esters;

10 weight-%-45 weight-% of one or more glycol ether or dibasic ester containing solvents; and 5 weight-%-27 weight-% of one or more non ionic surfactants selected from the group consisting of isotridecyl alcohol ethoxylate, dodecanol ethoxylate, tridecyl alcohol ethoxylate, ethoxylated 2,4,7,9-tetramethyl-5-decyne-4,7-diol, 2,4,7,9-tetramethyl-5-decyne-4,7-diol, ethoxylated C11-C15 secondary alcohols, and acetylenic diol containing surfactants, wherein the cleaning composition has a flash point above 110° C.

2. The composition of claim 1, wherein a surfactant concentration is 7 weight-%-20 weight-%.

3. The composition of claim 1, wherein the one or more glycol ether or dibasic ester containing solvents are selected from the group consisting of dimethyl 2-methylglutarate, diethylene glycol monobutyl ether, diethylene glycol monoethyl ether, ethylene glycol monophenyl ether, diethylene glycol monophenyl ether, polyethylene glycol monophenyl ether, and triethylene glycol monophenyl ether containing solvents.

4. The composition of claim 1, wherein a glycol ether or dibasic ester solvent concentration is 10 weight-%-25 weight-%.

5. The composition of claim 1, wherein a fatty acid methyl ester concentration is 30 weight-%-38 weight-%.

6. The composition of claim 1, wherein a fatty acid methyl ester concentration is 30%-38%; an alkylene carbonate concentration is 30%-38%; a surfactant concentration is 7%-20%; and a glycol ether or dibasic ester solvent concentration is 10%-25%.

7. The composition of claim 1, further comprising one or more diluting agents selected from water, chemicals, solids or liquids.

8. A method of cleaning for paper or carpet making equipment comprising contacting the equipment with a composition comprising ingredients selected from the group consisting of:

30 weight %-38 weight-% of one or more alkylene carbonates;

25 weight-%-45 weight-% of one or more fatty acid methyl esters selected from the vegetable oil methyl esters;

10 weight-%-45 weight-% of one or more glycol ether or dibasic ester containing solvents; and 5 weight-%-27 weight-% of one or more nonionic surfactants isotridecyl alcohol ethoxylate, dodecanol ethoxylate, tridecyl alcohol ethoxylate, ethoxylated 2,4,7,9-tetramethyl-5-decyne-4,7-diol, 2,4,7,9-tetramethyl-5-decyne-4,7-diol, ethoxylated C11-C15 secondary alcohols, and acetylenic diol containing surfactants, wherein the cleaning composition has a flash point above 110° C.

9. The method of claim 8, wherein the one or more glycol ether or dibasic ester containing solvents are selected from the group consisting of dimethyl 2-methylglutarate, diethylene glycol monobutyl ether, diethylene glycol monoethyl ether, ethylene glycol monophenyl ether, diethylene glycol monophenyl ether, polyethylene glycol monophenyl ether, and triethylene glycol monophenyl ether containing solvents.

10. The method of claim 8, wherein the composition or the equipment is contacted at an elevated temperature, which is below 130° C.

11. The method of claim 8, wherein a contact time is between 0.1 second to 5 hours.

12. The method of claim 8, wherein the composition is further diluted before or while in contact with the equipment with one or more diluting agents selected from water, chemicals, solids or liquids.

13. The composition of claim 1, wherein the alkylene carbonate is propylene carbonate, the one or more fatty acid methyl ester is selected from vegetable oil methyl esters and the one or more surfactant is selected from non-ionic surfactants.

* * * * *